United States Patent [19]

Lazenby

[11] Patent Number: 4,940,299

[45] Date of Patent: Jul. 10, 1990

[54] STORAGE CABINET

[76] Inventor: James E. Lazenby, 808 Daisy St., Monroeville, Ala. 36461

[21] Appl. No.: 360,381

[22] Filed: Jun. 2, 1989

Related U.S. Application Data

[63] Continuation-in-part of Ser. No. 218,975, Jul. 14, 1988, abandoned.

[51] Int. Cl.[5] ..... A47B 88/00

[52] U.S. Cl. ..... 312/285; 312/289

[58] Field of Search ..... 312/285, 286, 287, 290, 312/289, 250

[56] References Cited

U.S. PATENT DOCUMENTS

| | | | |
|---|---|---|---|
| 357,006 | 2/1887 | Hoffmann | 312/285 X |
| 566,010 | 8/1896 | Norkus | 312/285 X |
| 908,036 | 12/1908 | Ripking | 312/285 X |
| 1,355,150 | 10/1920 | Kluth | 312/285 |
| 1,745,593 | 2/1930 | Adams | 312/285 X |
| 2,637,616 | 5/1953 | MacDonald | 312/285 X |
| 2,763,366 | 9/1951 | Smith et al. | 312/244 X |
| 2,774,808 | 12/1956 | Bullock | 312/285 X |
| 2,987,846 | 6/1961 | Powell | 312/285 X |
| 3,050,356 | 8/1962 | Messmer | 312/244 X |

*Primary Examiner*—Joseph Falk

*Attorney, Agent, or Firm*—Phillips & Beumer

[57] ABSTRACT

A storage cabinet for use at manufacturing plants, construction sites, shops, etc. The cabinet is provided with two pairs of opposing storage compartments, vertically arranged for easy access to the stored items, such as tools and other equipment. Lifting pads are secured to the base of the cabinet and extend through the top of the cabinet, and rollers are provided at the bottom of the cabinet. Doors are provided at each of the four sides of the cabinet and are sized and positioned to provide easy access into each compartment.

10 Claims, 5 Drawing Sheets

STORAGE CABINET

CROSS-REFERENCE OF RELATED APPLICATION

This is a continuation-in-part of application Ser. No. 07/218975, filed July 14, 1988, now abandoned.

TECHNICAL FIELD

This invention relates to a cabinet having a central bearing frame or support structure around which a plurality of storage compartments are arranged.

BACKGROUND OF THE INVENTION

At manufacturing plants or construction sites, it is a must for all construction workers to be provided with means for storing tools and supplies, etc. At some sites it is necessary that such storage devices be elevated to different levels. For example, at multi-level construction sites, such as a multi-storied building, it may be necessary that, as construction progresses, the storage device be lifted from one floor to another. In order to provide this mobility, the storage device must be sturdily constructed and capable of being lifted by a hoisting device, such as a crane, to the various levels. Also, the storage device must be capable of being easily handled for lifting and loading for transportation to and from different jobs. In addition to the sturdy construction, it is, of course, necessary that the storage device have compartments that are readily accessible and configured to accept tools, supplies, etc., of various sizes and shapes for storage of such tools and supplies, etc.

In the past, storage devices, such as bins, have been provided in shops and at manufacturing and construction sites. Generally, the tools and supplies are randomly thrown or placed in a bin from the top and generally require the user to sort through the stored items in an effort to locate a particular tool or device. Storage cabinets, of course, are also used at such locations; however, the typical storage cabinet was sturdily and specifically designed for use in shops and at manufacturing and construction sites wherein such cabinets must be mobile and capable of withstanding the stresses placed thereon by a lifting apparatus, such as a crane, while also being compartmentalized to orderly accept tools, supplies, etc., of various sizes, weight, and shapes. In addition to providing the lifting capability as discussed above, the device of the present invention is provided with access means which assures that the components stored therein are readily accessible to the user from the facing surfaces of the cabinet rather than from through the top of a top opening gang box, as is often used at construction sites.

If it, therefore, an object of the present invention to provide a storage cabinet which is sturdily constructed and provided with compartments which are readily accessible from the outwardly facing sides of the cabinet.

It is another object of the present invention to provide such a storage cabinet in which each compartment shares a wall which is a load-bearing or structural support for the cabinet and to provide a cabinet which is sturdy enough to withstand stresses imposed thereon as a result of moving or lifting the loaded cabinet without distorting the structure.

It is yet a further object of the present invention to provide such a storage cabinet with access means which permits fast and easy retrieval of the stored items.

SUMMARY OF THE INVENTION

In accordance with this invention, a storage cabinet is provided having two pairs of opposing storage compartments. A vertical frame comprised of a pair of spaced flat structural members is arranged in spaced relation with a third flat structural member secured between the ends of the parallel members. These structural members, which typically are sheet metal panels, form the internal wall of each of the four compartments and extend upwardly from the floor which is secured to a base comprised of a plurality of channel irons secured together. The external walls of the compartments are constructed of formed sheet metal panels which are placed around the internal walls. Each of these panels forms a corner and adjoining side panels of the cabinet. Lifting pads are secured to the channel frame at the base and extend through the top of the cabinet to be grasped by a hoisting device, if desired. Doors are provided which are sized and positioned to provide unobstructed access into each compartment. Rollers are secured to a structural frame at the bottom of the storage cabinet.

DESCRIPTION OF THE PREFERRED EMBODIMENT

Figure 1:
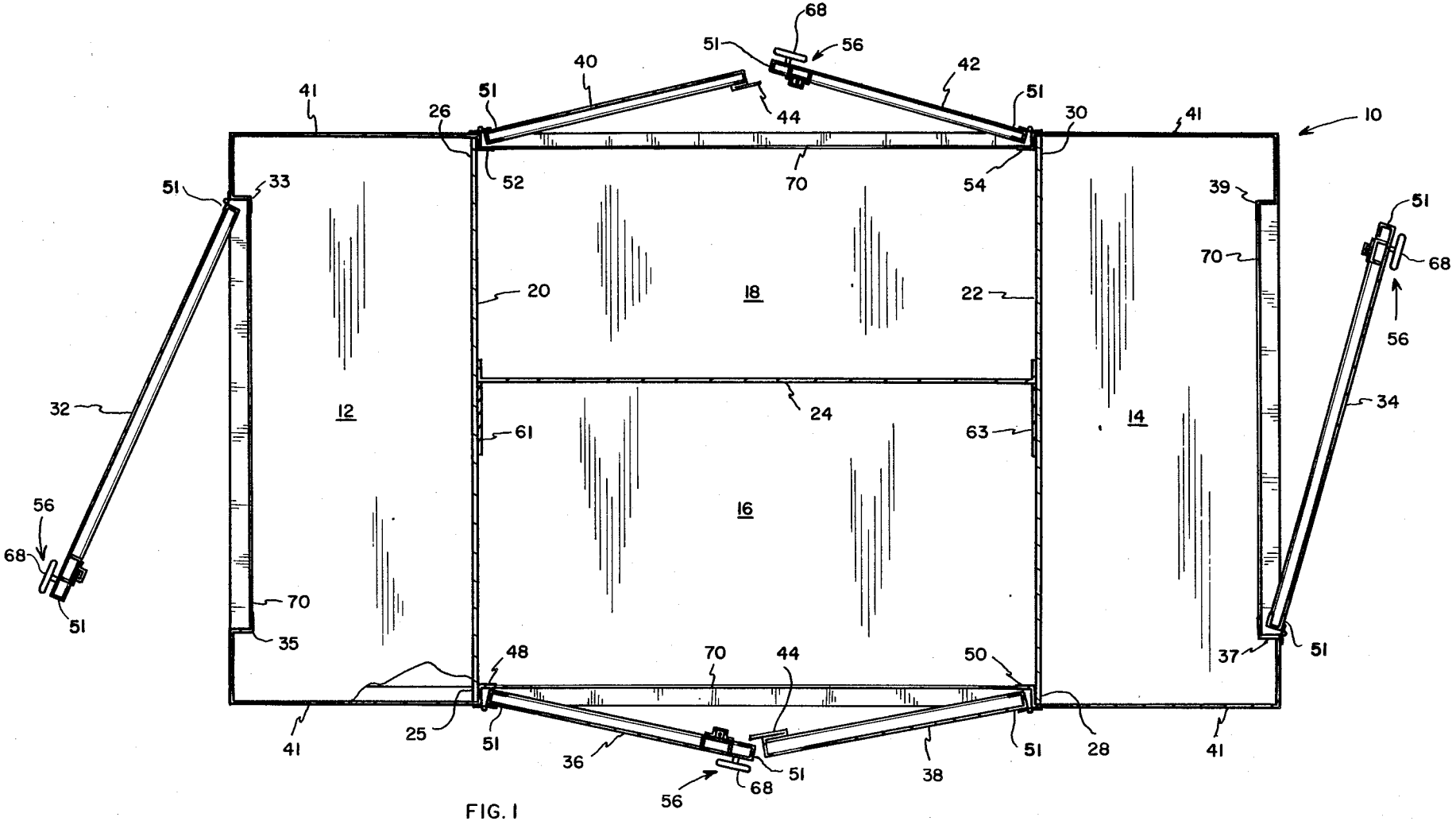
FIG. 1 is a sectional plan view illustrating one embodiment of the present invention.

As seen in FIG. 1, a storage cabinet 10 includes two end storage compartments 12 and 14 and two center compartments 16 and 18 sandwiched between and extending in normal relation to end compartments 12 and 14. Compartments 16 and 18 are of the same width but of different depth. FIG. 1 illustrates compartment 16 to be deeper than compartment 18; however, if desired, this could be reversed, or, alternately, the compartments may be of the same width and depth.

Figure 2:
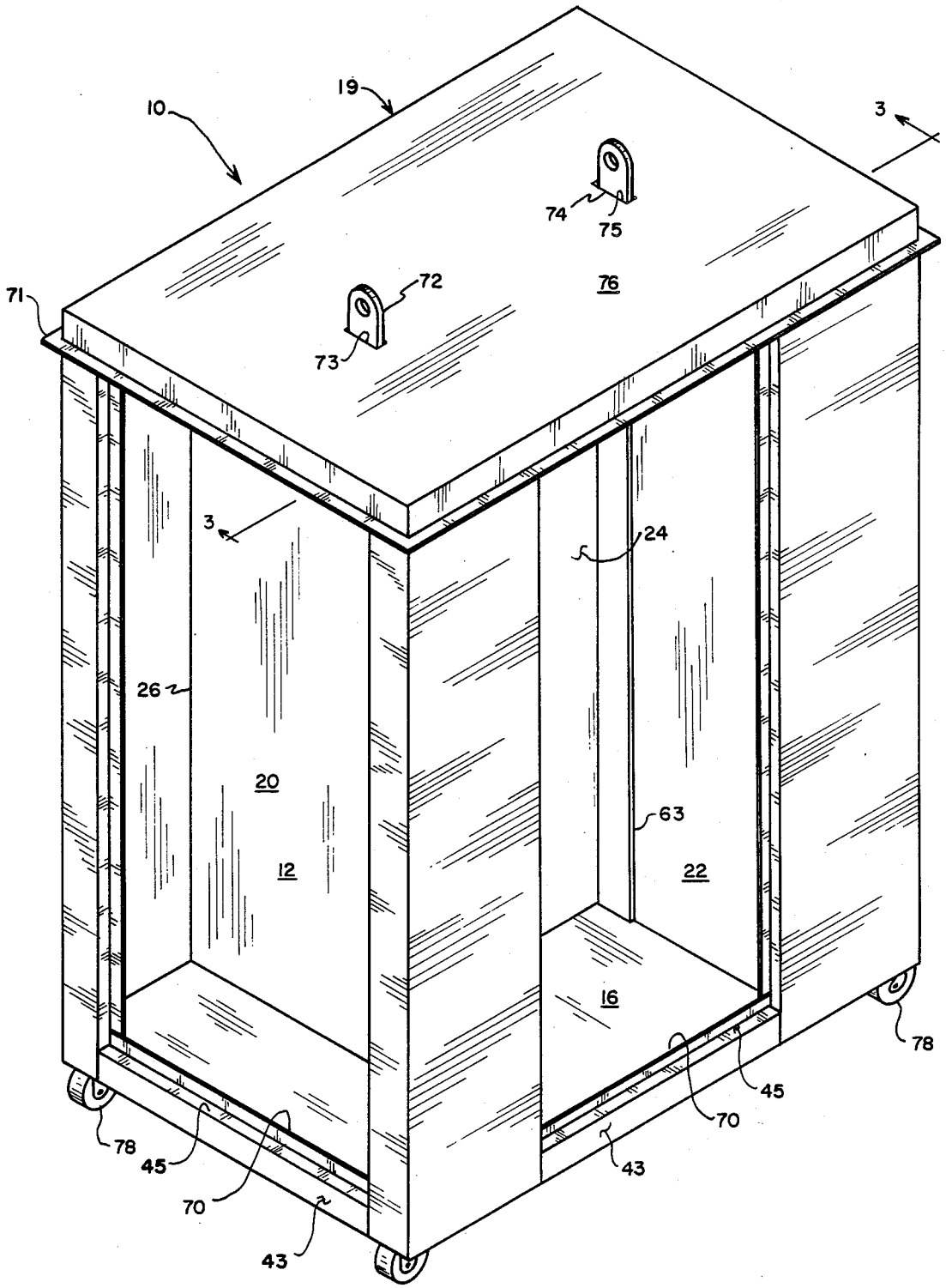
FIG. 2 is a pictorial diagrammatical view of another embodiment of the storage cabinet of the present invention, with the doors removed for clarity.
Figure 3:
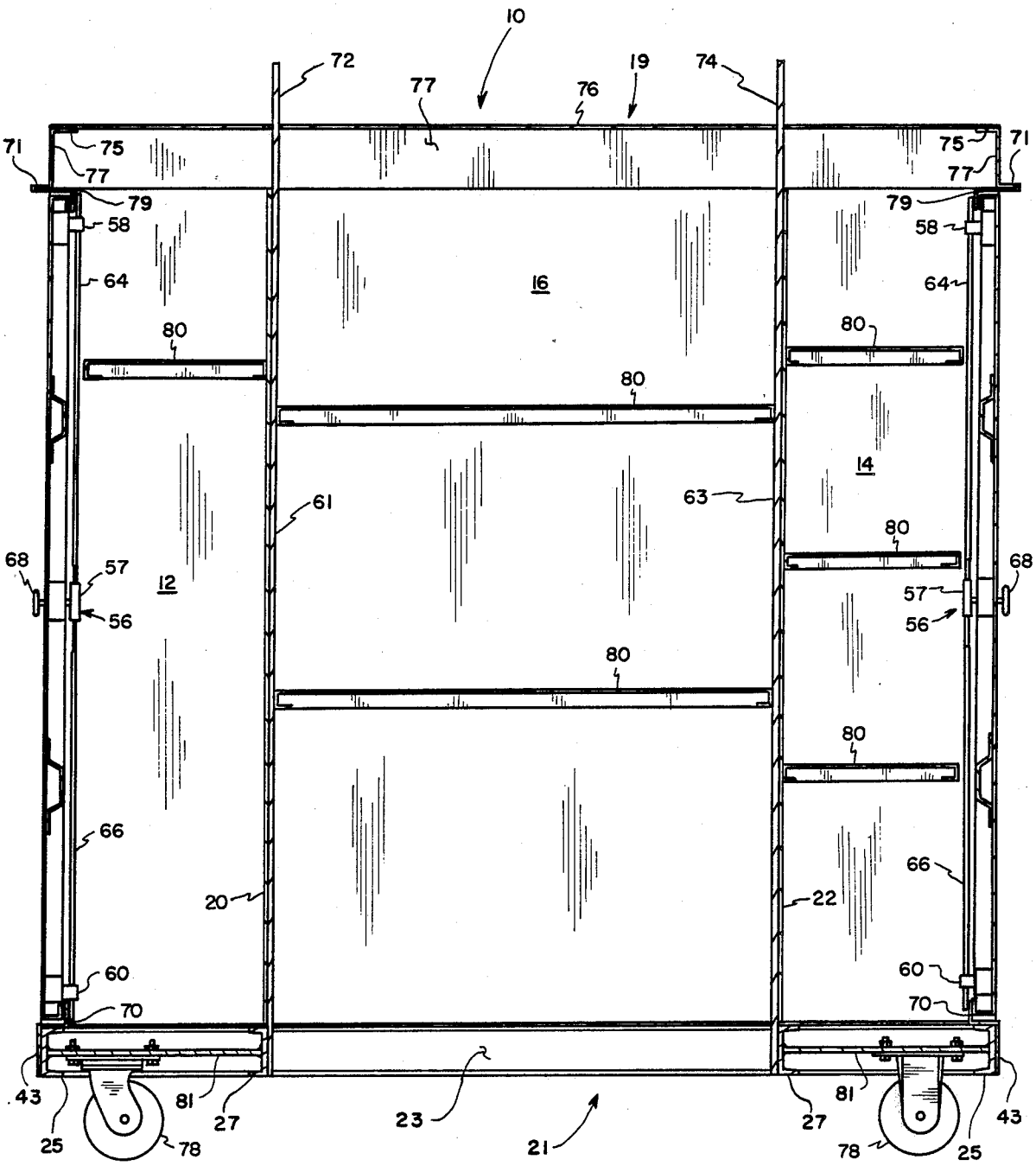
FIG. 3 is a sectional view taken along line 3—3 of FIG. 2.
Figure 4:
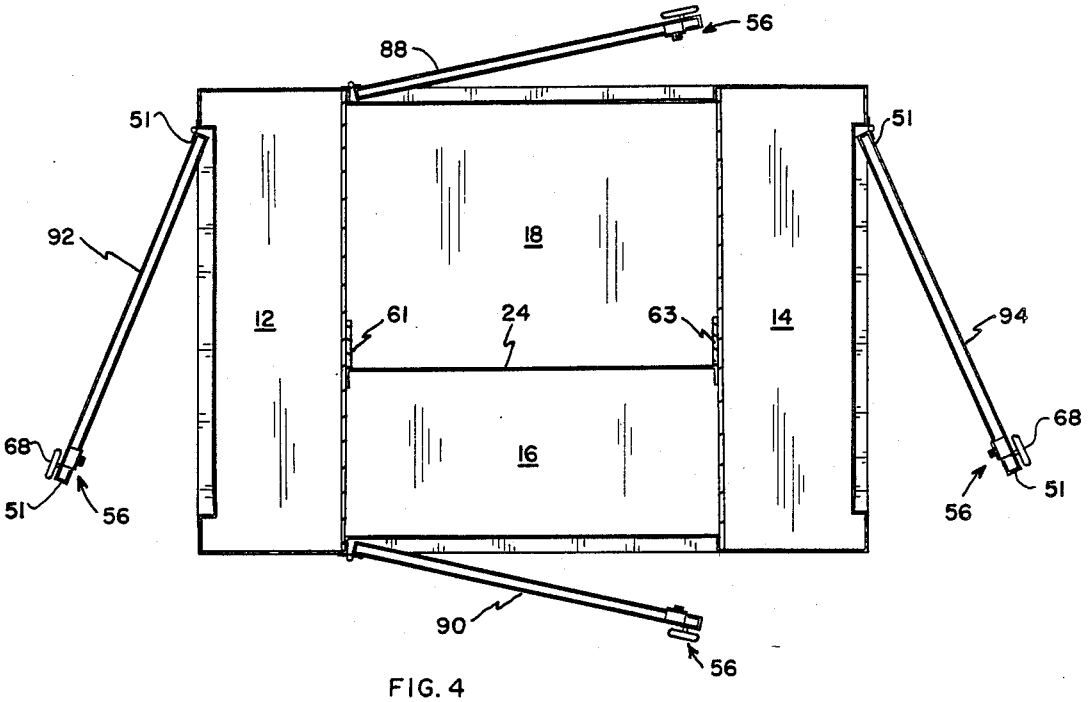
FIG. 4 is a sectional view taken along line 4—4 of FIG. 2.

To provide a sturdy structural support around which the compartments are located, a pair of continuous flat sheet metal dividers forming structural frame members 20 and 22 are disposed in substantially parallel spaced relation to form the rear walls for end compartments 12 and 14, respectively. A center one-piece continuous divider forms a structural support frame 24 which is secured to frame members 20 and 22 intermediate edges 25 and 26 and 28 and 30, respectively. Support frame 24 forms a common back wall for central compartments 16 and 18, and support members 20 and 22, respectively, form the back wall for compartments 12 and 14. Support members 20, 22, and 24 (FIG. 1) are provided with a substantially H-shaped cross-sectional configuration. A top assembly 19 (FIGS. 2, 3, and 6) encloses the top of the cabinet, and a base assembly 21 (FIG. 3) is provided for support of the upstanding walls 20, 22, and 24. Base assembly 21 includes a pair of substantially parallel side channel irons 23 (one shown in FIG. 3) and end channel irons 25 which are secured together to form a rectangular frame. A pair of spaced cross member channel irons 27 are secured to and extend between the side channel irons 23 (FIG. 3).

To provide access to end compartments 12 and 14, a pair of doors 32 and 34 (FIG. 1) are provided. The doors extend substantially across the width of the end compartments to provide easy access into the compartments, including the corners thereof. Door 32 is hinged by a pin hinge to an upstanding support member 33 and closes against a similar support member 35. Door 34 is hinged by a pin hinge to an upstanding support member 37 and closes against a similar support member 39.

Compartments 16 and 18 are each provided with a double door assembly comprised of doors 36 and 38 and 40 and 42 which extend across the width of these two compartments and are openable to provide easy access into the compartments, including the corners thereof. The door openings are unobstructed to permit easy insertion and removal of items into or out of the compartments.

Either one of the pair of doors 36 and 38 or 40 and 42 may be provided with a formed tee stop 44 against which the other door of the pair may abut for closing of the doors. Doors 36 and 38 are hinged by a pin hinge to a pair of upstanding support members 48 and 50, disposed adjacent edge 25 of frame member 20 and edge 28 of frame member 22, respectively. In like manner, doors 40 and 42 are hinged by a pin hinge to a pair of upstanding support members 52 and 54 disposed adjacent edge 26 of frame member 20 and end 30 of frame member 22, respectively.

As seen in FIG. 1, the corners and portions of adjoining sides of the cabinet are formed by four separate panels 41 (typically sheet metal). Each panel 41 includes end edges and an intermediate portion and is bent at the intermediate portion to form the corners of the cabinet. The edges terminate at door openings in the adjoining sides of the cabinet. The end edges of each panel 41 is bent into a substantially reverse L-shaped configuration (formed angle) to provide stiffeners which serve as the vertical door frames and support members for the doors of the cabinet. Upstanding support members 33, 35, and 37 and 39, 48, 50, 52, and 54 are formed in this manner.

Figure 5:
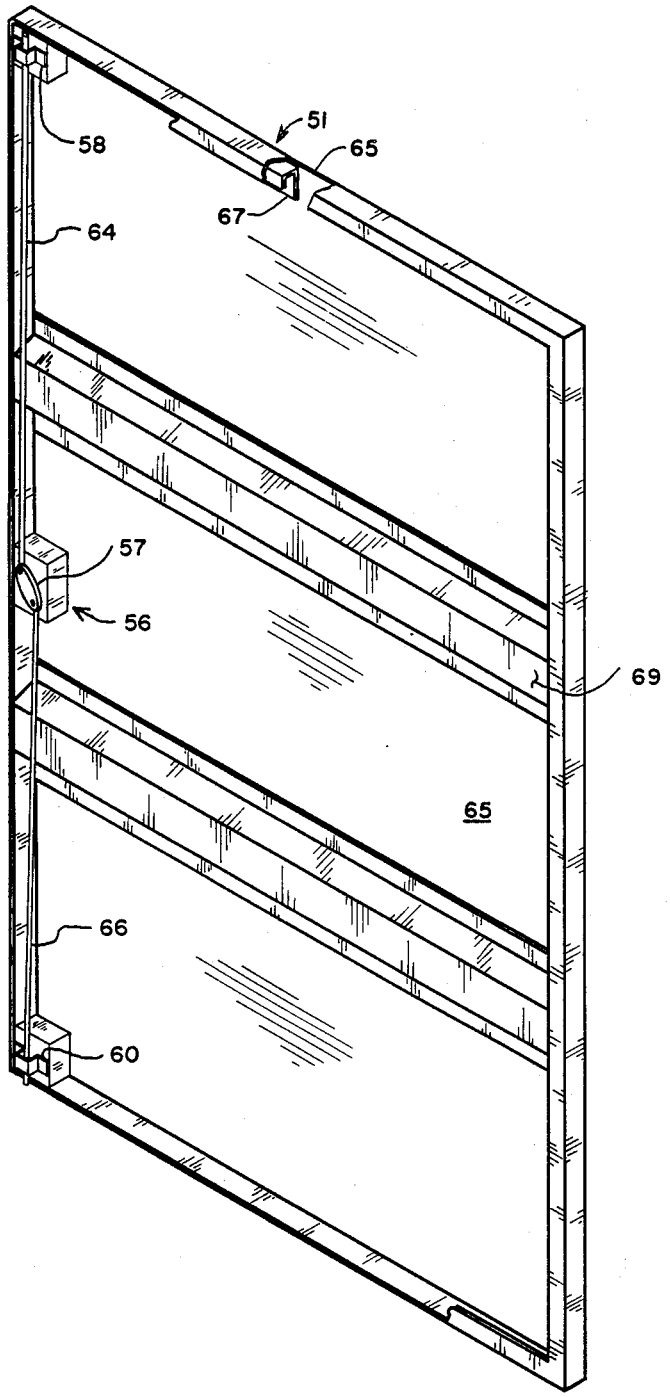
FIG. 5 is an elevational view of a door used in the construction of the cabinet of the present invention.

The doors are illustrated in FIG. 5 and are shown to include a panel 65 which is formed to provide stiffeners 51 at the edges of the door. A bent sheet metal member 67 is secured at the edges of the door to provide further rigidity to the doors. Formed sheet metal members 69 are secured across the width of the door. The formed stiffeners 51 are provided at all of the edges of all the doors except at the edges where formed tee stop 44 forms the stiffener and door stop.

A base panel 43 is provided across the lower portion of each of the door openings and is secured to the respective side and end channels 23 and 25 of the base assembly. A formed lower door stop 45 is provided at the upper surfaces of each panel 43. The lower door stop is formed by bending the upper edge of each panel 43 into a reverse, substantially L-shaped configuration.

Figure 6:
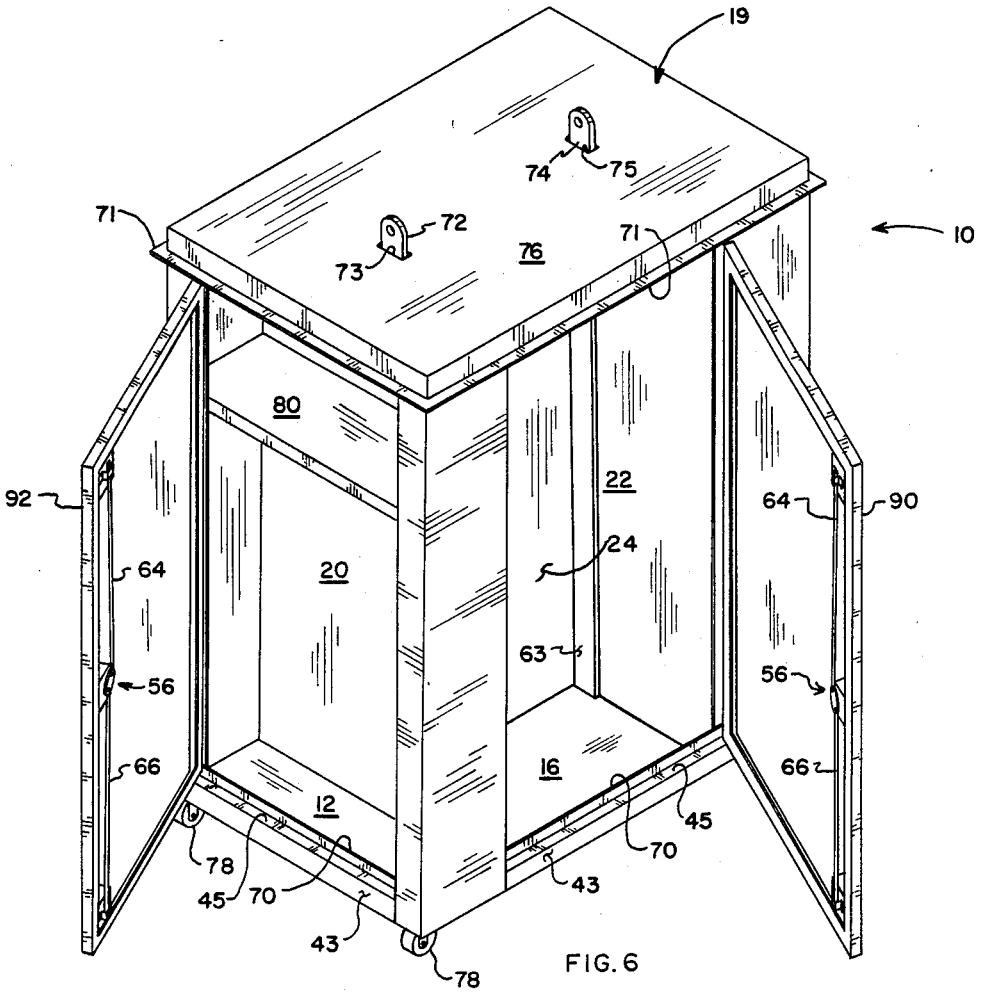
FIG. 6 is a pictorial view of another embodiment of the storage cabinet of the present invention.

To latch the doors in closed relation, a three-point concealed latch assembly 56 with a keyed lock is provided. As seen in FIGS. 3, 5, and 6, latch assembly 56 includes a pair of brackets 58 and 60 disposed at the upper and lower edges of the inside of the door. A rod 64 is secured to pass through bracket 58, and a second rod 66 is secured to pass through bracket 60. The rods are disposed for upward and downward movement by a cam member 57 coupled to a handle 68 on the outside of the door. Rods 64 and 66 secure the door by pivoting the ends of the rods to catch the inside lower and upper edges 70 and 79 of the door frames of the cabinet. Such securing mechanisms are well known in the art.

The top assembly 19 is comprised of a plurality of formed angle members 77 made of bent sheet metal which are secured together to form a rectangular frame, and upper cover member is secured to the top of the frame. Members 77 include an upper, inwardly extending, flanged surface 75 to which cover member 76 is secured and a lower formed portion 71 which forms a rain drip around the cabinet. Formed portion 77 also forms, at the door openings, the upper portion of the door frame which also serves as door stop 79. Panels 41 are secured (as by welding) at their upper portions to member 77.

To provide a means whereby the storage cabinet may be lifted to be located at different locations at the site, a pair of straps 61 and 68 (typically 11-gauge) are secured (as by welding) to channels 27 of base 21. Straps 61 and 63 include lifting ears 72 and 74 on the distal ends thereof. Straps 61 and 63 extend upwardly from channels 27 with ears 72 and 74 extending through slots 73 and 75 (FIG. 2) in an upper cover member 76 of the top 19 and through the center of gravity of the cabinet. Rollers 78 are provided at the lower corners of the cabinet to provide for rolling the storage cabinet to a desired location. To support the rollers, a metal plate support member 81 is secured between channel members 25 and 27 at each corner of the cabinet.

Shelves 80 are provided in the storage cabinet to store the items thereon. The shelves may be removable and placed at predetermined levels with the desired spacing therebetween; or, in the event that elongated items are to be stored in a vertical position, any of the compartments may be left without shelves.

One storage cabinet contemplated by the present invention is approximately 60 inches long, 60 inches high, and approximately 32 inches wide, with the center compartments 16 and 18 being 32 inches wide. Each end door is approximately 24 inches wide, and the side doors are disposed across the width of compartments 16 and 18 to provide unobstructed access into these compartments.

A second embodiment is shown in FIGS. 2–4 and 6 wherein like numerals refer to like parts. This embodiment is similar to the embodiment shown in FIG. 1 except that it is smaller and, therefore, uses only single doors 88 and 90 on the sides thereof. Typically, this embodiment measures 48 inches in length and 30 inches in depth. The width of center compartments 16 and 18 is approximately 24 inches as are doors 88 and 90 for center compartments 16 and 18. End doors 92 and 94 are approximately 24 inches. In both embodiments, the lifting straps 61 and 63 are typically made of 11-gauge, 4-inch wide metal.

The storage cabinet of the present invention is designed for use by members of various trades which generally use job site gang and storage containers, such as plumbers, steam fitters, electrical, heating and air-condition service men, sprinkler installers, carpenters, steel erecters, riggers, general contractors, and mechanics, and is also used by plant maintenance men and at various garages.

Even though parts of the cabinet are described as being secured together by welding, it is to be understood that other securing means, such as nuts and bolts and sheet metal screws, may be resorted to, if desired.

It can be seen from the foregoing that the applicant has provided a storage cabinet that is sturdily constructed in a simple manner and which provides easy and ready accessibility into the storage compartments.

I claim:

1. A tool and construction equipment storage cabinet for use at construction sites and plant buildings or the like, said storage cabinet comprising:

a top, a pair of substantially parallel ends, a pair of substantially parallel sides, a base comprising a plurality of channel iron members disposed in secured relation to form a substantially rectangular frame having a pair of spaced cross members, and a floor member secured to said channel members;

a first structural, continuous partition disposed between said top and said base;

a second structural, continuous partition positioned between said top and bottom in secured relation thereto, said second structural, continuous partition being in substantially parallel relation with said first structural, continuous partition;

a third structural, continuous, intermediate partition disposed in substantially normal relation to and extending in secured relation between said first and second partitions intermediate each end edge thereof, said third partition vertically extending between said floor member and said top, said partitions having a substantially H-shaped configuration and forming an internal rear wall of each of four compartments formed in said cabinet, each of said four compartments having a forward open portion;

a door assembly extending substantially across each of said four compartments, each door assembly disposed for enclosing a respective one of said four compartments at said forward portion thereof;

a first plurality of panel members, each substantially forming the ends, sides, and corners of said cabinet, each of said panel members including a pair of spaced vertical edges and an intermediate portion, said panels being bent at said intermediate portions to form a rigid corner, and each of said vertical edges of each said panel being positioned in one said end and one said side of said cabinet and being formed to provide vertical door frames for each said door; and a second plurality of panel members secured to and extending upwardly from said base, each extending at the base of said cabinet between said pairs of vertical door frames and formed to provide a lower door stop for each door.

2. A storage cabinet as set forth in claim 1 wherein said top includes a plurality of members secured together to form a substantially rectangular frame, said members having upper and lower portions and a cover member secured to said upper portion, said lower portion being formed to provide an upper door stop for each of said doors, and each of said first plurality of said panels having an upper section disposed for secured relation with said lower portion of said top members.

3. A storage cabinet as set forth in claim 2 including lifting means provided on said cabinet to permit hoisting thereof.

4. A storage cabinet as set forth in claim 4 wherein said lifting means includes a pair of members secured to said cross members of said base and extending upwardly therefrom and through said cover member to provide a lifting means whereby said cabinet may be hoisted to different locations.

5. A storage cabinet as set forth in claim 4 including shelving means positioned in predetermined said compartments at predetermined spaced intervals.

6. A storage cabinet as set forth in claim 5 including roller means secured to said base to permit rolling movement of said storage cabinet.

7. A storage cabinet as set forth in claim 6 wherein said cabinet includes first, second, third, and fourth sides, said first and third sides disposed in substantially parallel relation, said second and fourth sides being disposed in substantially parallel relation and in substantially normal relation to said first and third sides, and said door assemblies including a single door secured in hinged relation on each of said first, second, third, and fourth sides.

8. A storage cabinet as set forth in claim 7 wherein said cabinet includes first, second, third, and fourth sides, said first and third sides disposed in substantially parallel relation, said second and fourth sides being disposed in substantially parallel relation and in substantially normal relation to said first and third sides, said door assemblies including a single door secured in hinged relation on each of said first and third sides, and a double door assembly including a pair of door members secured in hinged relation on said second and fourth sides.

9. A storage cabinet as set forth in claim 7 including securing means for securing said door in a closed position.

10. A storage cabinet as set forth in claim 8 including securing means for securing said door in a closed position.

* * * * *